US008864449B2

(12) United States Patent
Telakowski et al.

(10) Patent No.: US 8,864,449 B2
(45) Date of Patent: Oct. 21, 2014

(54) DRIVE RING BEARING FOR COMPRESSOR DIFFUSER ASSEMBLY

(75) Inventors: Robert Telakowski, Windsor Locks, CT (US); John M. Beck, Granby, CT (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 1024 days.

(21) Appl. No.: 12/917,717

(22) Filed: Nov. 2, 2010

(65) Prior Publication Data

US 2012/0107101 A1 May 3, 2012

(51) Int. Cl.
*F04D 29/46* (2006.01)

(52) U.S. Cl.
CPC ..... *F04D 29/462* (2013.01)
USPC ..... 415/150; 415/160; 415/165

(58) Field of Classification Search
CPC ... F04D 27/00; F04D 27/002; F04D 27/0246; F04D 27/0253; F04D 29/46; F04D 29/462; F04D 29/464; F04D 29/624; F01D 17/165
USPC ..... 415/148, 150, 159–165; 29/898.7, 29/889.2, 889.22
See application file for complete search history.

(56) References Cited

U.S. PATENT DOCUMENTS 4,242,040 A * 12/1980 Swearingen ..... 415/113
5,344,285 A 9/1994 O'Sullivan et al.
5,592,821 A 1/1997 Alary et al.
6,210,104 B1 4/2001 Schonenborn
6,547,520 B2 4/2003 Zinsmeyer et al.
6,554,569 B2 4/2003 Decker et al.
6,814,540 B2 11/2004 Sishtla et al.
7,021,471 B2 4/2006 Abrams
7,025,566 B2 4/2006 Sasu et al.
7,140,839 B2 11/2006 McAuliffe et al.
7,407,367 B2 8/2008 McAuliffe et al.
7,459,001 B2 12/2008 Christiansen et al.
7,669,325 B2 3/2010 Husted et al.
8,092,157 B2 * 1/2012 McCaffrey ..... 415/160
2006/0133925 A1 6/2006 Bouru
2007/0286716 A1 * 12/2007 Noelle ..... 415/150
2009/0142185 A1 * 6/2009 Fath et al. ..... 415/159
2010/0054923 A1 * 3/2010 Beers et al. ..... 415/150

* cited by examiner

*Primary Examiner* — Edward Look
*Assistant Examiner* — Jesse Prager
(74) *Attorney, Agent, or Firm* — Carlson, Gaskey & Olds, PC

(57) ABSTRACT

A drive ring bearing has a body with a generally cylindrical outer peripheral surface, and a generally u-shaped cross-section, with over a circumferential portion of the body. A web defines the outer peripheral surface. Radially inwardly extending legs define the u-shape in combination with the web. A plurality of circumferentially spaced feet extend from the outer peripheral surface of the body to an inner peripheral surface of the body. In addition, a diffuser assembly incorporating the drive ring bearing, a compressor assembly including the diffuser assembly, and a method of mounting the drive ring bearing are also disclosed.

20 Claims, 2 Drawing Sheets

DRIVE RING BEARING FOR COMPRESSOR DIFFUSER ASSEMBLY

BACKGROUND

This application relates to a drive ring bearing for supporting a drive ring on an outer peripheral surface of a shroud in a compressor diffuser assembly.

Known compressors often include a centrifugal rotor which is driven to rotate and compress air from an axially inwardly extending inlet, and to a radially outer direction. The air is often directed into a diffuser section which serves to diffuse the compressed air as it moves outwardly and away from the rotor.

The diffuser section is often provided in part by a housing shroud which surrounds the rotor. In addition, variable vanes may be positioned within the diffuser section and are adjustable to change an angle of incidence for controlling the flow of the compressed air. The angle of incidence of the vanes is controlled by rotating a drive ring.

In the prior art, the drive ring has been supported on the shroud with large ball bearings.

SUMMARY

A drive ring bearing has a body with a generally cylindrical outer peripheral surface, and a generally u-shaped cross-section over a circumferential portion of the body. A web defines the outer peripheral surface. Radially inwardly extending legs define the u-shape in combination with the web. A plurality of circumferentially spaced feet extend from the outer peripheral surface of the body to an inner peripheral surface of the body.

In addition, a diffuser assembly incorporating the drive ring bearing, a compressor assembly including the diffuser assembly, and a method of mounting the drive ring bearing are also disclosed and claimed.

These and other features of the present invention can be best understood from the following specification and drawings, the following of which is a brief description.

DETAILED DESCRIPTION

Figure 1:
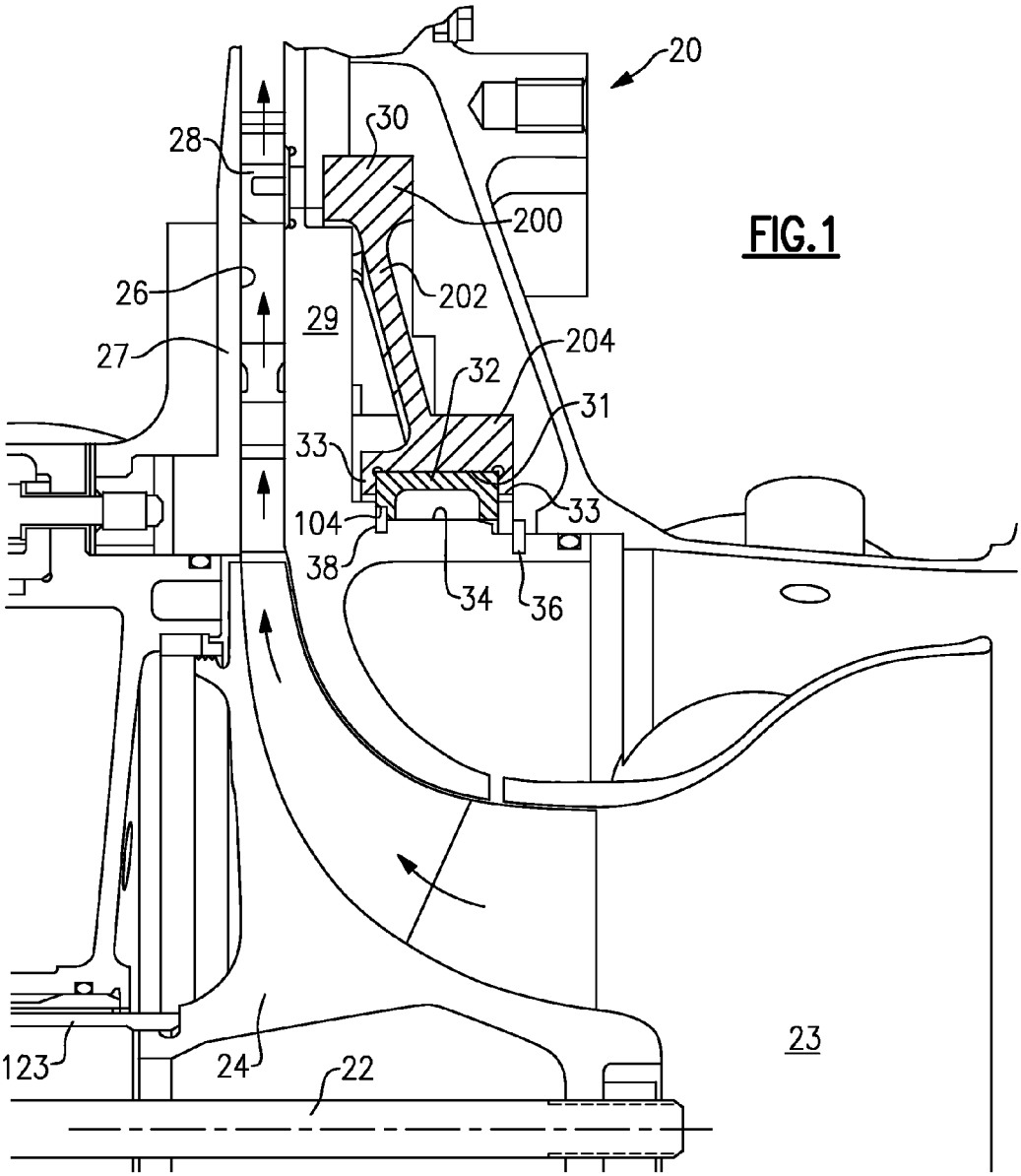
FIG. 1 is an assembly view of a compressor incorporating a drive ring bearing.

FIG. 1 shows a compressor assembly 20 incorporating a shaft 123 supporting a rotor 24. A tie rod 22 restrains the rotor 24. Air enters the rotor at an inlet 23 and is directed toward an outlet passage 26 in a diffuser section. The diffuser section is defined between housing portions 27 and 29, which are defined in part by a shroud.

Vanes 28 are positioned in the diffuser passage 26, and sit at an angle of incidence, which can be varied by rotating a drive ring 30. The connection of the drive ring 30 for changing the angle of the vanes 28 may be as known.

The drive ring 30 has an outer ring 200 and a plurality of webs 202 connected to an inner ring 204. The inner ring 204 is u-shaped and provided with inner support web 31 extending between side legs 33. A clip ring 36 mounts the drive ring 30 on an outer peripheral surface 34 of the shroud 29. A drive ring bearing 32 is mounted between the web 31 and the outer peripheral surface 34.

A pin 38 (also, see FIG. 3) is shown extending into a notch 104 in drive ring bearing 32, and also into shroud 29. The pin 38 serves to prevent relative rotation between the drive ring bearing 32 and the shroud 29.

During operation of the compressor 20, the drive ring 30 may be rotated to change the angle of incidence of vanes 28. When this occurs, there is relative rotation between the drive ring bearing 32 and portions 31 and 33 of the drive ring 30. The drive ring bearing 32 supports the drive ring 30 for this limited rotation. In general, this rotation may be less than 10° of rotation of the drive ring 30.

Figure 2:
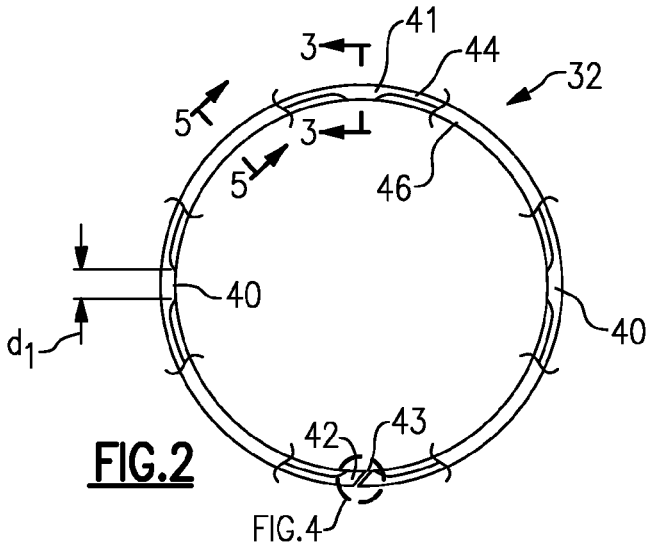
FIG. 2 is a side view, partially cut-away of a drive ring bearing.

As shown in FIG. 2, the drive ring bearing 32 includes a circumferential body with a plurality of feet 40, 41, and 42. One foot 41 includes the notch 104 which receives the pin 38, as mentioned above. One of the feet, 42, is actually formed of two separate ends of the drive ring bearing 32. The eight legs 46 serve to center the drive ring bearing 32 on the outer surface 34 of the shroud 29.

The drive ring bearing 32 is provided with a cross-section including web 44 and legs 46 at locations circumferentially between the feet 40, 41, and 42. The web or section 44 provides radial support for drive ring 30, and the legs 46 provide axial support. Each of the feet 40, 41, and 42 extend along a circumferential distance at the inner periphery of $d_1$. In one embodiment, $d_1$ was 0.820" (2.08 cm).

As shown, sides of the feet 40 extend at a radius until reaching a tangent at the web 44. The radius may be between 0.74" (1.88 cm) and 0.76" (1.93 cm) in embodiments.

Figure 3:
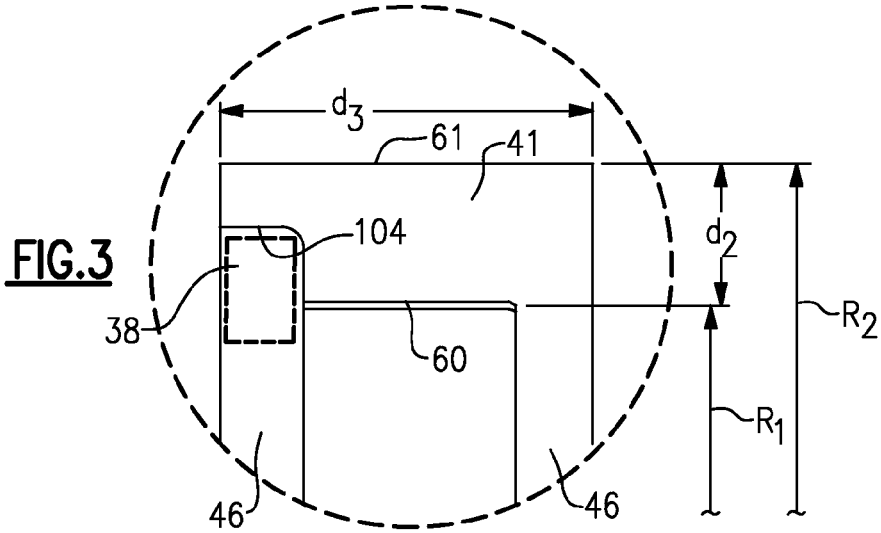
FIG. 3 is a cross-sectional view of along line 3-3 as shown in FIG. 1.

FIG. 3 is a cross-sectional view through one of the feet 41. As shown, a radius $R_1$ is defined to the inner periphery 60 of the bearing 32, and a radius $R_2$ is defined to the outer periphery 61. A thickness $d_2$ is defined between the surfaces 60 and 61. In one embodiment, $d_2$ was 0.396" (1.01 cm). Notch 104 is formed at one end of the foot 41. The drive ring bearing 32 extends along an axial length $d_3$. In one embodiment, $d_3$ was 0.991" (2.52 cm).

In one embodiment, $R_1$ was 4.99" (12.7 cm) and $R_2$ was 5.39" (13.7 cm).

In embodiments, a ratio of $R_1$ to $R_2$ was between 0.90 and 0.95, and more narrowly between 0.923 and 0.930.

In embodiments, a ratio of $d_3$ to $d_2$ was between 2.49 and 2.51.

In embodiments, a ratio of $d_1$ to $d_2$ was between 1.50 and 2.70, and more narrowly between 1.63 and 2.50.

Figure 4:
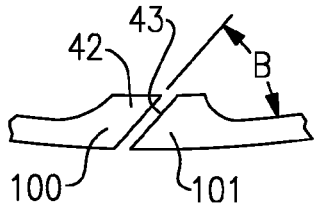
FIG. 4 is an enlarged view of the portion identified by the circle 4 in FIG. 2.

FIG. 4 shows a detail of the drive ring bearing 32, and the foot 42 which is formed of the spaced ends 101 and 100. As shown, an angle B is defined along a gap 43 between the ends 101 and 100. In one embodiment, B was 45° and may be between 30° and 60°, and more narrowly between 40° and 50°.

Figure 5:
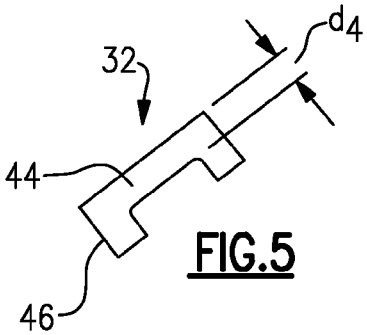
FIG. 5 is a cross-sectional view along line 5-5 of FIG. 2.

FIG. 5 shows another detail of the drive ring bearing 32, and in particular the web 44 and the feet 46.

As shown, the web 44 extends along a radial dimension of $d_4$. A ratio of $d_4$ to $d_2$ was between 0.400 and 0.450, and more narrowly between 0.409 and 0.439.

The drive ring bearing 32 is initially placed on the drive ring 30, and the pre-assembled unit then mounted onto the shroud 29 with the pin 38 moving into the notch 104. The cut or gap 43 between the ends 100 and 101 as shown in FIG. 4 facilitates the insertion of the drive ring bearing 32 into the drive ring 30. The drive ring bearing 32 can be wrapped into a diameter that is smaller than its free state, and allowing it to pass inside of the legs 33 of the drive ring 30.

The cut or gap 43 serves two purposes. First, it allows the bearing to be rolled in on itself as mentioned above for insulation. Second, it "breaks the hoop" such that the bearing does not sustain large changes in diameter as it changes temperature.

The drive ring bearing 32 may be formed out of a carbon reinforced graphite filled resin material, or other materials that provide high stiffness with a low co-efficient of friction.

The drive ring bearing 32 may be formed of injection molding techniques. In delivering the fiber-reinforced material into a mold, the alignment of the fibers may change from that which is expected by the material manufacturer. As such, the co-efficient of friction may change from what was expected from manufacturer's specifications, and as exists in the final product. The co-efficients of friction should be studied in the final product to understand their complete reaction.

Although embodiment of this invention have been disclosed, a worker of ordinary skill in this art would recognize that certain modifications would come within the scope of this invention. For that reason, the following claims should be studied to determine the true scope and content of this invention.

What is claimed is:

1. A drive ring bearing comprising:

a bearing body having a generally cylindrical outer peripheral surface, and a generally u-shaped cross-section over a circumferential portion of the body, with a web defining said outer peripheral surface, and radially inwardly extending legs defining said u-shape in combination with said web; and a plurality of circumferentially spaced feet extending from said outer peripheral surface of said body to an inner peripheral surface of said body.

2. The bearing as set forth in claim 1, wherein a ratio of a circumferential distance of said feet at the inner peripheral surface to a radial thickness of said body being between 1.50 and 2.70.

3. The bearing as set forth in claim 1, wherein at least one of said feet has a notch for receiving a pin to lock said bearing to a structure in a compressor.

4. The bearing as set forth in claim 1, wherein one of said feet is defined by spaced ends, having an intermediate gap, with a gap angle defined along said gap, said angle being between 30° and 60°.

5. The bearing as set forth in claim 1, wherein a ratio of a radius to an inner peripheral surface of said body to a radius to the outer peripheral surface of the body is between 0.900 and 0.950.

6. The bearing as set forth in claim 1, wherein a ratio of the thickness of said web to a thickness between said inner peripheral surface and said outer peripheral surface is between 0.400 and 0.450.

7. The bearing as set forth in claim 1, wherein a ratio of an axial length of said body to a thickness of said body between said inner and outer peripheral surface is between 2.250 and 2.750.

8. A diffuser assembly including:

a shroud defining a diffuser section receiving a movable vane;

a drive ring for adjusting said movable vane, said drive ring being positioned outwardly of a cylindrical outer surface on said shroud, and a drive ring bearing positioned between said drive ring and the outer surface of said shroud, the drive ring bearing having a bearing body with a generally cylindrical outer peripheral surface, and a generally u-shaped cross-section over a circumferential extent of said body, with a web defining said outer peripheral surface, and radially inwardly extending legs defining said u-shape in combination with said web; and said body also having a plurality of circumferentially spaced feet extending from said outer peripheral surface of said body to an inner peripheral surface of said body.

9. The assembly as set forth in claim 8, wherein a ratio of a circumferential distance of said feet at the inner peripheral surface to a radial thickness of said body being between 1.50 and 2.70.

10. The assembly as set forth in claim 8, wherein at least one of said feet has a notch for a pin to lock said bearing to said shroud.

11. The assembly as set forth in claim 8, wherein one of said feet is defined by spaced ends, having an intermediate gap, with a gap angle defined along said gap, said angle being between 30° and 60°.

12. The assembly as set forth in claim 8, wherein a ratio of a radius to an inner peripheral surface of said body to a radius to the outer peripheral surface of the body is between 0.900 and 0.950.

13. A compressor assembly comprising:

a compressor rotor positioned within a shroud receiving a movable vane and defining a diffuser for the rotor;

a drive ring for adjusting said movable vane, said drive ring being positioned outwardly of a cylindrical outer surface on said shroud, and a drive ring bearing positioned between said drive ring and the outer surface of said shroud, the drive ring bearing having a bearing body with a generally cylindrical outer peripheral surface, and a generally u-shaped cross-section over a circumferential extent of the body, with a web defining said outer peripheral surface, and radially inwardly extending legs defining said u-shape in combination with said web; and said body also having a plurality of circumferentially spaced feet extending from outer peripheral surface of said body to an inner peripheral surface of said body.

14. The assembly as set forth in claim 13, wherein a ratio of a circumferential distance of said feet at the inner peripheral surface to a radial thickness of said body being between 1.50 and 2.70.

15. The assembly as set forth in claim 13, wherein at least one of said feet has a notch for receiving a pin to lock said bearing to said shroud.

16. The assembly as set forth in claim 13, wherein one of said feet is defined by spaced ends, having an intermediate gap, with a gap angle defined along said gap, said angle being between 30° and 60°.

17. The assembly as set forth in claim 13, wherein a ratio of a radius to an inner peripheral surface of said body to a radius to the outer peripheral surface of the body is between 0.900 and 0.950.

18. A method of installing a drive ring bearing into a diffuser assembly comprising the steps of:

(a) providing a drive ring bearing having a generally cylindrical outer peripheral surface, and a generally u-shaped cross-section over a circumferential portion of said bearing, with a web defining said outer peripheral surface, and radially inwardly extending legs defining said u-shape in combination with said web, a plurality of circumferentially spaced feet extending from said outer peripheral surface of said body to an inner peripheral surface of said body;

(b) mounting the bearing onto a drive ring for driving at least one vane in a diffuser assembly; and (c) inserting a pin through a notch in said drive ring bearing, said pin locking said drive ring bearing to a shroud, said shroud defining a portion of the diffuser assembly.

19. The method as set forth in claim 18, wherein a ratio of a circumferential distance of said feet at the inner peripheral surface to a radial thickness of said body being between 1.50 and 2.70.

20. The method as set forth in claim 18, wherein one of said feet is defined by spaced ends having intermediate gap, with a gap angle defined along said gap, said angle being between 30 degrees and 60 degrees.

* * * * *